US006887298B1

(12) United States Patent
Kojo et al.

(10) Patent No.: US 6,887,298 B1
(45) Date of Patent: May 3, 2005

(54) METHOD AND EQUIPMENT FOR SMELTING NON-FERROUS METAL SULPHIDES IN A SUSPENSION SMELTING FURNACE IN ORDER TO PRODUCE MATTE OF A HIGH NON-FERROUS METAL CONTENT AND DISPOSABLE SLAG

(75) Inventors: Ilkka Kojo, Kirkkonummi (FI); Markku Kytö , Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/030,891

(22) PCT Filed: May 4, 2000

(86) PCT No.: PCT/FI00/00396

§ 371 (c)(1),
(2), (4) Date: Jun. 3, 2002

(87) PCT Pub. No.: WO00/70103

PCT Pub. Date: Nov. 23, 2000

(30) Foreign Application Priority Data

May 14, 1999 (FI) ..... 991110

(51) Int. Cl.[7] ..... C22B 9/00
(52) U.S. Cl. ..... 75/585; 266/159; 266/177
(58) Field of Search ..... 75/585; 266/159, 266/177

(56) References Cited

U.S. PATENT DOCUMENTS 4,283,045 A * 8/1981 Melcher et al. ..... 266/162
4,470,845 A * 9/1984 Yannopoulos ..... 75/629
4,645,186 A * 2/1987 Hanniala ..... 266/212
4,857,104 A 8/1989 Victorovich et al.
5,458,672 A 10/1995 Ding
5,662,730 A 9/1997 Akagi et al.

FOREIGN PATENT DOCUMENTS

| | | |
|---|---|---|
| JP | 58-221241 | 12/1983 |
| JP | 59-050132 | 3/1994 |
| JP | 09-316562 | 12/1997 |

OTHER PUBLICATIONS

Abstract for JP 90024898: Dialog File351: Derwent WPI AccNo. 1984–172960, Apr. 28, 1984.

Abstract for 58–221241; Dialog File347 Japio PubNo. 58–221241, Dec. 22, 1983.

Abstract for 09–316562 Dialog File 347 Japio PubNo. 09–316562, Dec. 9, 1997.

* cited by examiner

*Primary Examiner*—Melvyn Andrews
(74) *Attorney, Agent, or Firm*—Morgan & Finnegan, L.L.P.

(57) ABSTRACT

The present invention relates to a method and equipment, whereby matte with a high non-ferrous metal content and disposable slag are produced simultaneously in a suspension-smelting furnace from non-ferrous sulphide concentrate. According to the invention, a carbonaceous reducing agent is charged to the lower furnace of a suspension smelting furnace via tuyeres to the part of the furnace which has a reduced cross-sectional area.

12 Claims, 2 Drawing Sheets

Figure 1:
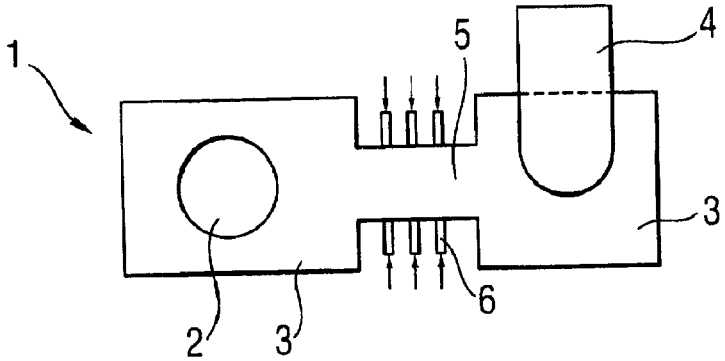

METHOD AND EQUIPMENT FOR SMELTING NON-FERROUS METAL SULPHIDES IN A SUSPENSION SMELTING FURNACE IN ORDER TO PRODUCE MATTE OF A HIGH NON-FERROUS METAL CONTENT AND DISPOSABLE SLAG

The present invention relates to a method and equipment, whereby matte with a high non-ferrous metal content and disposable slag are produced simultaneously in a suspension smelting furnace from non-ferrous sulphide concentrate. According to the invention, a carbonaceous reducing agent is charged to the lower furnace of a suspension smelting furnace via tuyeres to a section of the furnace with a reduced cross-sectional area.

It is characteristic in suspension smelting that the final phase equilibrium between the slag and matte only arises during the slag reactions taking place in the lower furnace. In other words, the potentially imbalanced over-and under-oxidized compounds formed in the reaction shaft still react with each other in the slag phase, particularly in the primary discharge point of the shaft suspension under the reaction shaft, so that the massive slag and matte phase are almost in the composition defined by their thermodynamic composition. In addition to the previously mentioned equilibrium-determining copper already dissolved in the slag, copper-rich matte, undissoluble to the slag, remains in the slag as a mechanical suspension, which does not manage to settle in a realistic time.

It is known before that slag with a low copper content can be produced in a suspension smelting furnace such as flash smelting furnace, when fixed coke or some other carbonaceous substance is used in the reduction of slag and the copper oxidule dissolving therein and especially magnetite which increases the viscosity of the slag and slows down the separation of molten matte particles contained in the slag by settling.

In U.S. Pat. No. 5,662,370 a method is described, in which it is essential that the carbon content of the carbonaceous material to be charged to the reaction shaft is at least 80%, that at least 65% of the material particles are under 100 $\mu$m and at least 25% between 44–100 $\mu$m. Particle size is defined precisely, because, according to said patent, the reduction of magnetite with unburnt coke occurs under two mechanisms and particle size is of decisive significance with regard to said mechanisms. If the rough coke powder size is about 100 $\mu$m or greater, the particle size of the unburnt part is also great and for this reason coke remains floating on the slag surface and reactions are slow. When particle size is reduced, the powder coke enters the slag and thus comes into direct contact with the magnetite to be reduced, which accelerates the reaction rate.

In Japanese patent application 58-221241 a method is described, in which coke breeze or coke breeze together with pulverized coal are charged into the reaction shaft of a flash smelting furnace through a concentrate burner. The coke is fed into the furnace so that the entire surface of the melt in the lower furnace is evenly covered with the unburnt powder coke. According to the application, the degree of reduction of magnetite decreases when the grain size is ultra-fine, so grain size used is preferably from 44 $\mu$m to 1 mm.

The slag layer covered by unburnt coke, which remains on the molten slag bath decreases considerably the partial pressure of oxygen. The highly reducing atmosphere arising from the coke layer causes for example damages to the lining of the furnace.

In JP patent 90-24898 there is described a method, in which pulverized coke or coal with particle size of under 40 mm is fed into the flash smelting furnace to replace the oil used as an extra fuel and maintain the desired temperature in the furnace.

JP patent application 9-316562 applies to the same method as the previously mentioned U.S. Pat. No. 5,662,370. The difference from the method of the US patent is that carbonaceous material is fed to the lower part of the reaction shaft of the flash smelting furnace, to prevent said carbonaceous material from burning before it reaches the slag and the magnetite to be reduced contained therein. The particle size of the carbonaceous material is essentially the same as the distribution described in the US patent.

A weakness of the previously described methods is that the reduction area is the same where slag material and non-ferrous metallic matte come to when they settle from the reaction shaft and separate from the gas phase in the lower furnace. However, in a suspension smelting furnace, fine grained material such as copper matte particles does also drift with the gas phase to the back of the furnace and uptake. When these smallest particles separate from the gas flow in the back of the furnace and settle to the surface of the slag phase, their settling in the slag phase is very slow due to just the small particle size. Because slag mainly is tapped from the back or side of the furnace, these particles do not manage to settle through the slag phase. Instead, they drift together with the slag to be tapped out of the furnace and add to the copper content of slag.

Another weakness in some of the previously described methods is the small particle size of the coke, in that these coke particles do not settle at all from the gas phase but continue with the gas phase to the uptake and from there on to a waste-heat boiler as a reducing agent. In the boiler the coke particles react and generate unnecessary energy in the wrong place, which may even limit total process capacity as the waste-heat boiler capacity diminishes.

One clear disadvantage of the previously described methods is that the reducing impact of the coke and then the minimum content of the slag are directed in an uncontrolled manner throughout the lower furnace area including particularly the area underneath of the reaction shaft, which has an essential impact on the non-ferrous metal content of the matte produced. In other words, the massive coke layer which forms on the surface of the slag phase renders the process uncontrollable. Now in the method developed, it is possible to reduce the slag further without essentially affecting the metal content of the massive non-ferrous metallic matte such as copper or nickel matte produced in the process without disturbing the slag reactions in the shaft suspension.

In a method according to the present invention developed for non-ferrous metal production in a suspension-smelting furnace, the slag forming in a lower furnace is injected with pulverized coke or other carbonaceous reducing agent via tuyeres into an area, which does not disturb either the natural slag reactions of the suspension which discharges from a reaction shaft and the generation of matte. So the tuyere injection is either done in the area between the reaction shaft and the uptake, under the uptake or in a separate extension of the lower furnace located after the uptake. The difficulty of a tuyere injection in metallurgical processes is that its impact area is short depth-wise and in a conventional suspension smelting furnace effective impact would not be possible due to the width of the furnace. For this reason, according to the present invention, a throttle area with an essentially reduced cross-sectional area is incorporated into the furnace, where the tuyeres are located. It is essential that the slag-tapping hole is located so that the total amount of melt has to flow through this tuyere area, thereby reducing the slag. The reduction area precedes a settling area, where the matte and metal particles separated from the slag by reduction can settle. The essential features of the invention will become apparent in the attached patent claims.

It is also known before that the viscosity of slag in slag reduction decreases with lowering of ferric iron content which increases viscosity, wherein the settling of particles separated in reduction occurs more rapidly than in a normal suspension smelting. In addition, in the method of the present invention the flows caused by the injection achieve desired turbulence in the melt, so the small particles therein which settle slowly have an improved chance of joining each other or straight to the matte phase, which in turn makes the cleansing of slag from metal more effective.

Figure 2:
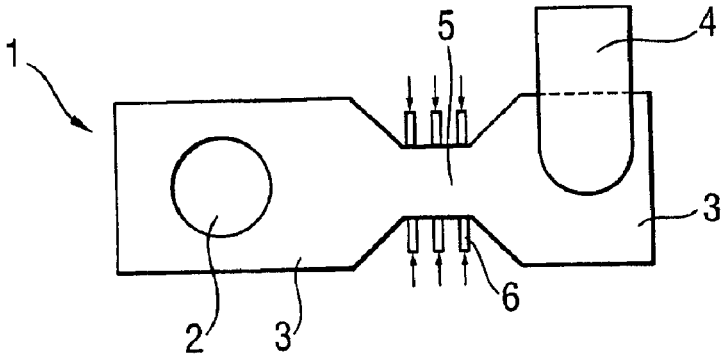

The invention is described further in the attached diagrams, where:

FIGS. 1 and 2 present schematic cross-sections of the suspension smelting furnace, where an alternative offered by this invention has been applied by positioning tuyeres on the lower furnace between the reaction shaft and uptake and FIGS. 3, 4, 5, 6 and 7 present likewise cross-sections of the suspension smelting furnace, in which the tuyeres have been placed after the uptake and an own settling area has formed to the lower furnace.

FIG. 1 presents schematically a cross-section of a suspension smelting furnace 1, where a reaction shaft 2, a lower furnace 3 and an uptake 4 can also be seen. In the area between the reaction shaft and uptake in the lower furnace an essentially right-angled throttle point 5 is formed, where the cross-sectional area of the furnace is decreased. A reducing agent such as coke is charged through a tuyere 6 into this neck.

The alternative presented in FIG. 2 is essentially the same as in FIG. 1, but throttle point 5 is formed more smoothly than in the previous case. In both FIGS. 1 and 2, the tapping holes for matte and slag are located normally at the back of the lower furnace (not shown in diagram). The settling area of the lower furnace following the throttle point is in both cases equal to the width of the primary lower furnace.

Figure 3:
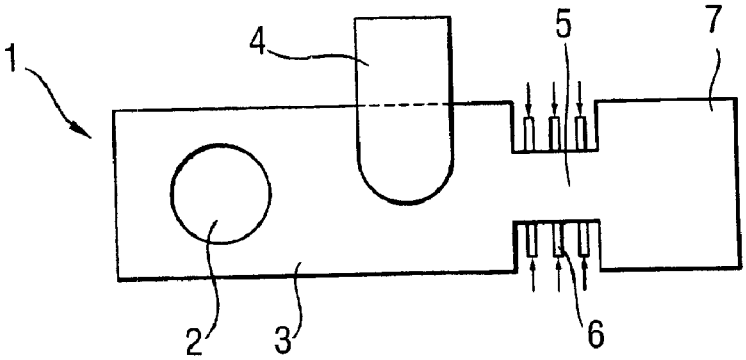
Figure 4:
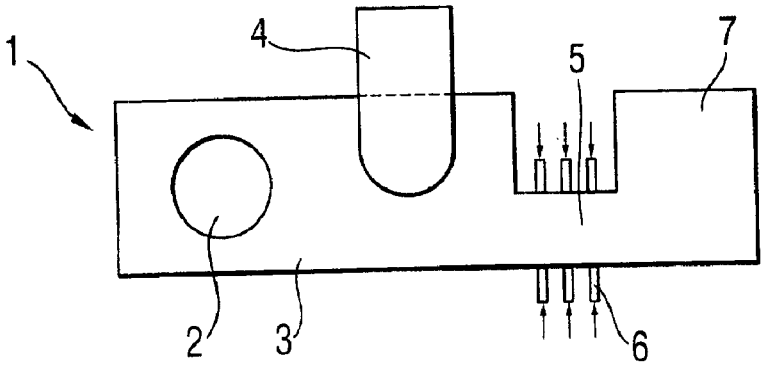
Figure 5:
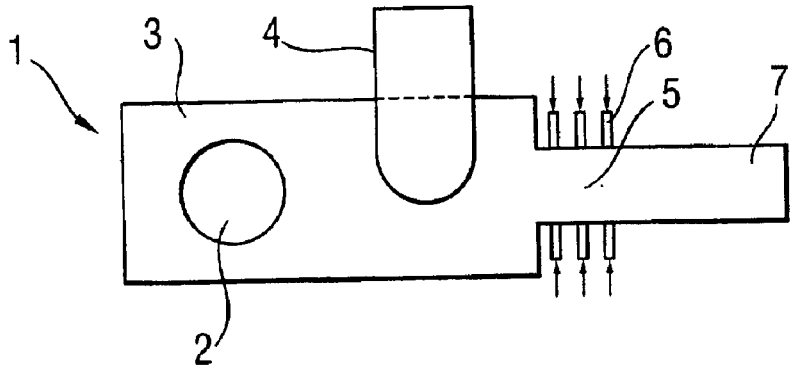
Figure 6:
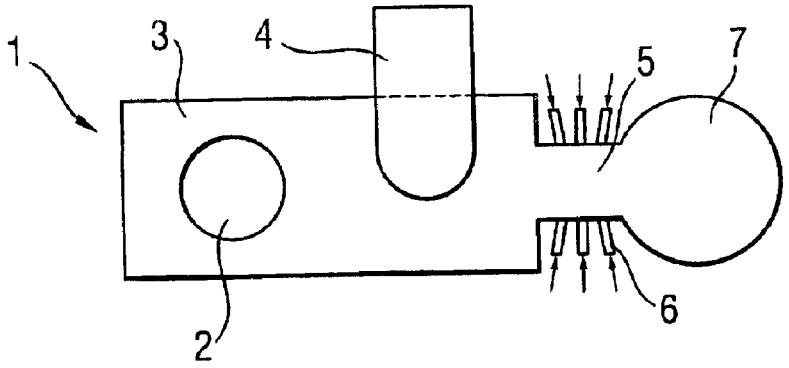
Figure 7:
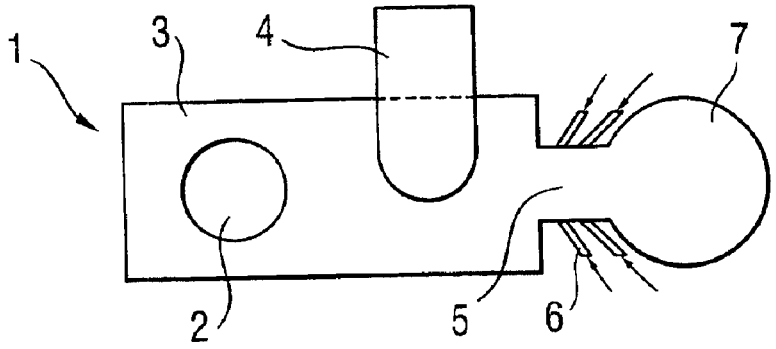

FIGS. 3, 4, 5, 6 and 7 present an alternative where the neck point is formed in the area of the lower furnace after the uptake. In the case of FIG. 3, the lower furnace is throttled on opposite sides and tuyeres 6 have been located on the throttle point 5. After the throttle point, there is an extension part 7, which acts as a settling area, as described earlier. The furnace structure in FIG. 4 is otherwise the same as FIG. 3, but the furnace has been throttled on the other side only. In the solution presented in FIG. 5, the lower furnace does not have the extended settling area, but the end of the furnace is in cross-sectional area essentially the size of the throttle point. FIGS. 6 and 7 show that the settling area can also be formed other than in a right-angled shape. In FIGS. 1–6, the tuyeres are positioned perpendicular to the melt, but in FIG. 7 the tuyeres are positioned in reverse at an angle to the melt flow. The tapping holes for matte and slag presented in FIGS. 3–7 are located at the very back of the settling area, although they are not shown in more detail.

What is claimed is:

1. A method for smelting non-ferrous metal sulphides in a suspension smelting furnace, to produce matte with a high non-ferrous metal content and disposable slag, the method comprising:

injecting a carbonaceous chemical reducing agent for chemically reducing slag into a throttle point formed in a lower furnace, in which throttle point the width and cross-sectional area of said furnace are decreased the chemical reducing agent being injected, via tuyeres, into a slag layer.

2. A method according to claim 1, wherein the entire melt, including matte and slag, flows through the throttle point.

3. A method according to claim 1, wherein the chemical reduction point is in the lower furnace in the area between the reaction shaft and uptake.

4. A method according to claim 1, wherein a chemical reduction point is in the area of the lower furnace after the uptake.

5. A method according to claim 1, wherein the chemically reduced slag is channeled to a settling area before being discharged from the furnace.

6. Equipment for smelting non-ferrous metal sulphides in a suspension smelting furnace, producing matte with a high non-ferrous metal content and slag which is reduced for disposal, the equipment comprising a smelting furnace having a reaction shaft, an uptake and a lower furnace which acts as a settler and is arranged below the reaction shaft and uptake, the lower furnace being furnished with a throttle point having a reduced width and reduced cross-sectional area and tuyeres placed therein for introducing a chemical reducing agent.

7. Equipment according to claim 6, wherein the throttle point is formed in an area of the lower furnace between the reaction shaft and the uptake.

8. Equipment according to claim 6, wherein the throttle point is formed in an area of the lower furnace on a side of the uptake which is opposite the reaction shaft.

9. Equipment according to claim 6, wherein the lower furnace is furnished with a settling area after the throttle point.

10. Equipment according to claim 9, wherein a slag-tapping hole is located in said settling area.

11. Equipment according to claim 9, wherein the width of the settling area is equal to that of the lower furnace.

12. Equipment according to claim 9, wherein the width of the settling area is equal to that of the throttle point.

* * * * *